United States Patent [19]

Miller et al.

[11] Patent Number: 5,000,334

[45] Date of Patent: Mar. 19, 1991

[54] TABLE RECEPTACLE

[76] Inventors: Agnes M. Miller; Russell W. Miller, Jr., both of 7121 Linsdale, Detroit, Mich. 48204

[21] Appl. No.: 182,619

[22] Filed: Apr. 18, 1988

[51] Int. Cl.[5] ..... B65D 51/18

[52] U.S. Cl. ..... 220/601; D7/584; D9/431; D34/1; 220/910

[58] Field of Search ..... 220/83, 376, 380; D7/16, 17, 29, 1; D34/1, 4, 6; D9/431, 350, 351, 353

[56] References Cited

U.S. PATENT DOCUMENTS

D. 285,849 9/1986 Hughes ..... D34/1

3,335,901 12/1965 Edwards ..... 206/515

OTHER PUBLICATIONS

1981 Sweet's Cat. File, vol. 1, Fibremart Designs, Inc.; Design Series 100.

*Primary Examiner*—Jimmy G. Foster

*Assistant Examiner*—G. W. Reece

*Attorney, Agent, or Firm*—Dykema Gossett

[57] ABSTRACT

A table receptacle is for use in a restaurant or banquet hall. The receptacle has a dish body and a refuse retention cap. The retention cap adjoins the dish body and is separable from it. An opening in the cap extends over an area that is less than a parallel area over which the cap extends. Paper refuse from unwrapped packages containing complements to a meal may be pushed through the opening into an interior of the receptacle and retained therein by the retention cap. The receptacle with its refuse contents may be disposed of as a unit.

11 Claims, 1 Drawing Sheet

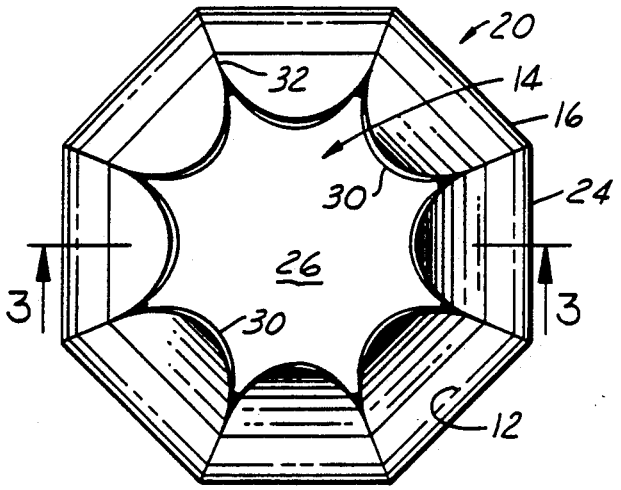
FIG. 1
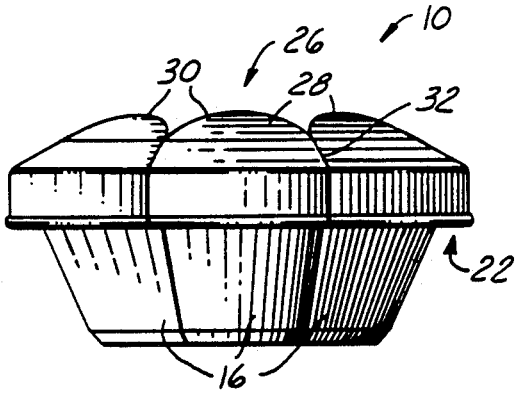
FIG. 2
FIG. 3
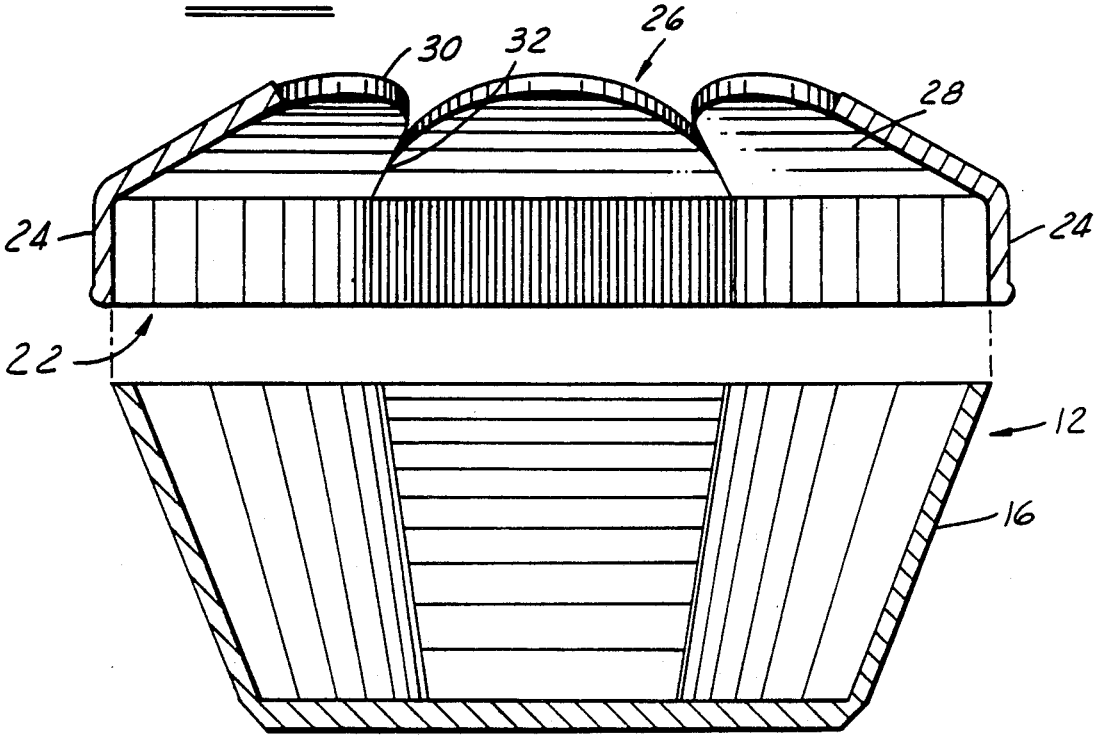

TABLE RECEPTACLE

FIELD OF THE INVENTION

The present invention relates generally to a receptacle for use with table settings in a restaurant or banquet hall. More particularly, the present invention relates to a table receptacle as a part of a table setting for a table in a restaurant or banquet hall, the receptacle having an interior adapted to receive and retain crumbled paper refuse discarded as wrappers from packaged condiments, breadsticks, crackers, appetizers, and like products that are placed on the table to be unwrapped and consumed.

BACKGROUND OF THE INVENTION

It is customary to place on tables in restaurants and banquet halls a variety of packaged condiments, breadsticks, crackers, appetizers, and like products to be consumed before, during, and after a meal. These consumable products are complements to the main meal and ostensibly function to whet the appetite of a restaurant or banquet hall patron. Thus, they are not to detract from the appetite.

But detract often they do: if not by filling up a patron so that when the main meal arrives he or she is less desirous of it, then by detracting from the visual aspect of appetite with such clutter on the banquet table as discarded wrappers, usually cellophane or the like, that had packaged the products complementing the meal. Patrons appear to be sensitive to the clutter as they attempt to tidy up the table by crumbling the paper in a dish or ashtray. Such expediencies are usually not successful, however, as the dishes only serve to locate the refuse but not to contain its resilient expansion from its condensed crumpled condition. Additionally, ashtrays produce risks of fires. In either case, a dish or ashtray provides an additional article to clean for the next table setting, and with the uncontained refuse in the dish or ashtray, which is apt to spill out of it, there will most probably be a need to clean around the dish, including the floor, the chairs, and, perhaps, the patron's lap.

OBJECTS OF THE INVENTION

Because of the untidiness that table packaged meal complements generate, it is one object of the present invention to provide a table receptacle for use on a table in a restaurant or banquet hall to contain the untidiness.

It is another object of the present invention to provide a table receptacle having an interior adapted to receive and retain crumbled paper refuse discarded as wrappers from packaged condiments, breadsticks, crackers, appetizers, and like products that are placed on the table to be unwrapped and consumed.

Yet another object of the present invention is to provide a table receptacle that may be conveniently assembled and placed on a table so that paper refuse may be pushed through an opening into the receptacle and retained therein.

Yet still another object of the present invention is to make a provision for table refuse from wrappers of packaged meal complements by providing a table receptacle which may be disposed of with the refuse contained within it.

Another object of the present invention is to provide a table receptacle that is stackable so as to minimize storage space, easily assembled for efficient table setup, readily disposable for quick table clearing, and inexpensive so as not to place an unwieldly economic burden on restaurant and banquet hall proprietors in the course of functioning advantageously otherwise.

SUMMARY OF THE INVENTION

Objects just discussed and other objects are accomplished in the present invention by a table receptacle for use in a restaurant or banquet hall. The receptacle has an interior adapted to receive and retain crumbled paper refuse discarded as wrappers from packaged condiments, breadsticks, crackers, appetizers, and like products that are placed on the table to be unwrapped and consumed.

The structure of the receptacle includes a dish body that has an open top. The dish body has eight sides to form the octagonal shape of the open top.

The structure of the receptacle also includes a refuse retention cap that is separable from the dish body. In the preferred embodiment, the retention cap has an octagonal mouth surrounded by a retention cap rim. The retention cap mouth and rim mate with the top of the dish body to form the unitary structure of the receptacle.

The retention cap has a topside opening which extends over an area less than a parallel area over which the underside mouth extends. Retention scallops, which have rounded free ends and contiguous sides, border the opening of the retention cap.

In the normal orientation of the receptacle, the retention scallops project at an inclination upwardly from where the scallops are contiguous to one another, so that, when the retention cap and the dish body form the unitary structure of the receptacle, the retention cap is concave with respect to the interior of the receptacle. The opening bordered by the rounded ends of the scallops extends between adjacent scallops to the contiguous sides of the adjacent scallops. This structural detail forms movement traps for trapping unfolding refuse to retain the refuse within the receptacle.

Accordingly, paper refuse may be pushed through the opening into the interior of the receptacle and retained therein by the retention cap.

Because of the open top structure of the dish body and the open mouth structure of the retention cap, and because the retention cap is separable from the dish body, the retention cap may be separately stacked with other retention caps, and the dish body may be separately stacked with other dish bodies to conveniently package and store the component parts of the table receptacle.

Preferably, the receptacle is made of a disposable paper or plastic foam material. A waiter, waitress, or other service personnel may conveniently dispose of the receptacle along with the paper refuse stuffed therein and replace the discarded receptacle with a new, easily-assembled receptacle placed on the table.

BRIEF DESCRIPTION OF THE DRAWINGS

FIG. 1 is a top view of the table receptacle that is the subject matter of the present invention.

FIG. 2 is a side view of the table receptacle shown in FIG. 1.

FIG. 3 is a side section view of the table receptacle taken in the direction of 3—3 of FIG. 1 and showing the retention cap of the receptacle lifted up from its position resting on the dish body of the receptacle.

DETAILED DESCRIPTION OF THE PREFERRED EMBODIMENTS

Referring to all of the figures, a table receptacle 10 that is the subject matter of the present invention is shown. It is to be used in a restaurant or banquet hall to receive and retain crumbled paper refuse discarded as wrappers from packaged condiments, breadsticks, crackers, appetizers, and like products that are placed on the table to be unwrapped and consumed.

The structure of the receptacle 10 includes a somewhat conventional bowl or dish body 12, particular reference being made to FIG. 3. It is conventional in that, as would be expected of a bowl, the dish body 12 has an open top 14. It is also conventional that the dish body 12 would be so structured as to have a base 16 that extends over an area less than the area over which the open top 14 extends. Thus, the side walls 18 of the dish body 12 angle outwardly from the base 16 as they extend from the base 16 to the open top 14.

What is perhaps unconventional about dish body 12 is its shape. As can be seen with particular clarity in FIG. 1, the dish body 12 of the preferred embodiment of the present invention is not rounded, but in the particular instance has eight sides 18. This is not, however, a limitation of the invention, so that the dish body 12 may have a rounded bowl structure or more or less sides 18 than the dish body 12 of the preferred embodiment. The structural consequence of the shape of the dish body 10 in most instances only would be that the open top 14 would be shaped accordingly. Thus, in the instance of the preferred embodiment, the open top 14 is octagonal.

The structure of the receptacle 10 also includes a refuse retention cap 20 that is separable from the dish body 12. In the preferred embodiment, the retention cap 20 has at its underside, as it is normally oriented when in use, an octagonal mouth 22 surrounded by an eight-sided retention cap rim 24. The retention cap rim mates with the open top 14 of the dish body 12 to form the unitary structure of the receptacle 10.

The retention cap 20 has a topside opening 26, relative to the underside mouth 22. The opening 26 extends over an area that is less than a parallel area over which the underside mouth 22. Retention scallops 28, which have rounded free ends 30 and contiguous sides 32, border the opening 26 of the retention cap 20. Contiguous sides 32 of the scallops 28 are integral, in the preferred embodiment two together forming a fold that separates contiguous scallops 28.

The retention scallops 28 project at an inclination upwardly from the retention cap rim 24 to the rounded free end 30. This means that the retention cap 20 is concave with respect to the interior of the receptacle 10, when the retention cap 20 and the dish body 12 form the unitary structure of the receptacle 10.

The opening 26, which is bordered by the rounded ends 30 of the scallops 28, extends between adjacent scallops 28 to the contiguous sides 32 of the adjacent scallops 28. This structural detail forms movement traps 33 for trapping unfolding refuse to retain the refuse within the receptacle 10 in a manner to be explained in connection with an explication of the use of the receptacle 10. But, before, an advantage associated with the separability of the retention cap 20 and the dish body 12 will be discussed.

The preferred configurations of the dish body 12 and the retention cap 20 and the structural separability of the retention cap 20 from the dish body 12 allows for an advantage in storing the receptacle 10 until use of it. According to this storage advantage, the retention cap 20 may be separately stacked with other retention caps, one retention cap having its scallops 28 received through the open mouth 22 of another so that the one retention cap 20 is seated inside of the other. In the same manner, the dish body 12 may be separately stacked with other dish bodies, one having its base 16 received through the top opening 22 of another so that the one dish body 12 is seated inside of the other. The stacks of dish bodies and retention caps may be packaged together or separately and may be assembled when the receptacle 10 is to be used.

Preferably, the receptacle 10 is made of a disposable paper or plastic foam material, so that a waitress, waiter, or other service personnel may conveniently dispose of the receptacle along with the paper refuse stuffed in it and replace the receptacle with a new, easily-assembled receptacle 10, placed on the table. The material is also chosen for available colors and textures, so that the receptacle 10 may give an appearance that is complimentary to the table setting.

In use, the table receptacle 10 is assembled from a single package containing stacked retention caps 20 and dish bodies 12 or from separate packages containing retention caps 20 and dish bodies 12, respectively. Assembling the receptacle 10 simply requires that the retention cap 20 receive into its open mouth 22 the open top 14 of the dish body 12 with the retention cap rim 24 surrounding the dish body 12. When paper, foil or cellophane wrappers are unwrapped from their contents so that the contents may be consumed, the crumpled wrapper refuse may be pushed through the opening 26 of the retention cap 20, into the interior of the receptacle 10 and retained therein by the retention cap 20. As the crumbled up paper begins to regain its precrumpled shape, as would occur to some extend according to the resiliency of the packaging product, the retention scallops 28 prevent the uncrumpling paper from escaping back through the opening 26 in the retention cap 20. Parts of the uncrumpling wrappers will be trapped in the movement traps 33 that are extensions of the opening 26 between adjacent scallops 28. When the table is cleared as a part of the cleaning up procedure of the restaurant or banquet hall, the complete receptacle 10 is to be tossed or discarded with the refuse contained in it, and a new assembled receptacle 10 is placed on the table along with a new table setting.

Although only one embodiment of this invention has been illustrated and described, it will be apparent to those skilled in the art that other modifications are within the spirit of this invention so that the scope of the invention is limited only by the claims.

We claim:

1. A table receptacle for use in a restaurant or banquet hall, the receptacle comprising in combination:

a dish body; and a refuse retention cap having a retention cap rim adjoining the dish body, the retention cap and the dish body enclosing a receptacle interior, the retention cap having an underside mouth and a topside opening extending over an area that is less than a parallel area over which the underside mouth extends, the cap also having retention scallops, each retention scallop projecting at an inclination away from the retention cap rim and away from the receptacle interior to a rounded free end, each retention scallop projecting between adjacent retention scallops, the retention scallops having contiguous sides and the rounded free ends of the retention scallops bordering the topside opening, the retention cap including movement traps for unfolding paper, each movement trap defined by the topside opening extending around the free ends of adjacent scallops to meet at contiguous sides, whereby paper refuse may be pushed through the topside opening into the receptacle interior and the paper will be retained therein by the retention cap, including containment of unfolding paper refuse by the movement traps as unfolding paper slides along the rounded free ends toward the contiguous sides and into the movement traps.

2. The table receptacle described in claim 1, wherein the retention scallops project upwardly at an inclination toward the topside opening.

3. The table receptacle described in claim 2, wherein the retention cap is concave with respect to the interior of the receptacle.

4. The table receptacle described in claim 1, wherein the cap is separable from the dish body so that retention caps and dish bodies of a multiplicity of table receptacles may be respectively stacked to minimize storage of the table receptacles when not in use.

5. The table receptacle described in claim 4, wherein the dish body includes a top which mates with the retention cap rim to form a unitary structure.

6. The table receptacle described in claim 5, wherein the retention cap includes retention scallops bordering the opening of the retention cap so that the opening extends between adjacent scallops to form movement traps for trapping unfolding refuse to retain the refuse within the receptacle.

7. The table receptacle described in claim 6, wherein the retention scallops project upwardly from where the scallops are contiguous to one another.

8. The table receptable described in claim 7, wherein the retention cap is concave with respect to the interior of the receptacle.

9. The table receptacle described in claim 4, wherein the retention cap and the dish body are made of a disposable product.

10. The table receptacle described in claim 4, wherein the retention cap and the dish body are made of a paper product.

11. The table receptacle described in claim 4, wherein the retention cap and the dish body are made of a thermostat resin foam.

* * * * *